United States Patent [19]

Cho

[11] Patent Number: 4,793,147

[45] Date of Patent: Dec. 27, 1988

[54] DRAINAGE DEVICE FOR ROOM AIR CONDITIONER

[75] Inventor: Wooyeon Cho, Kyungkido, Rep. of Korea

[73] Assignee: Sam Sung Electronic Co., Ltd., Soowon, Rep. of Korea

[21] Appl. No.: 96,580

[22] Filed: Sep. 15, 1987

[30] Foreign Application Priority Data

Sep. 16, 1986 [KR] Rep. of Korea ..... 86-14354[U]

[51] Int. Cl.[4] ..... F25D 21/00

[52] U.S. Cl. ..... 62/272; 62/285

[58] Field of Search ..... 62/272, 171, 290, 406; 261/DIG. 46, 27; 251/324

[56] References Cited

U.S. PATENT DOCUMENTS 1,011,260 12/1911 Spinney ..... 251/324
3,910,061 10/1975 Irwin ..... 62/290
3,910,062 10/1975 Rojas ..... 62/406
4,289,713 9/1981 Goetti ..... 261/27
4,510,766 4/1985 Curtis ..... 62/171

*Primary Examiner*—Henry Bennett
*Attorney, Agent, or Firm*—Saidman, Sterne, Kessler & Goldstein

[57] ABSTRACT

The present invention prevents corrosion to air conditioners caused by stagnant condensed water. The invention solves the defects of known room air conditioners through movement of a conveniently located manually operable lever which controls the placement of a piston in a cylinder located on the bottom of a fluid drain pan inside the outdoor portion of the air conditioner. The cylinder contains slots which, when the lever has so positioned the piston, may alternatively be opened or closed. When the slots in the cylinder are open, the stagnant water may drain from the fluid drain pan.

3 Claims, 5 Drawing Sheets

DRAINAGE DEVICE FOR ROOM AIR CONDITIONER

BACKGROUND OF THE INVENTION

1. Field of the Invention

The present invention relates to devices for drainage of fluids from room air conditioners. More specifically, the invention relates to devices for conveniently draining stagnant, condensed water which is collected in the outdoor portion of a room air conditioner, through use of a drainage lever which is conveniently accessible from the indoor side of the air conditioner.

2. Related Art

In known air conditioners, condensed water which is collected during the operation of the air conditioner is stored in an outdoor portion of the air conditioner. Often, this stagnant water has caused corrosion in the body of the air conditioner because it has remained there for an unduly long period of time. the stagnant water has remained there because of handling difficulties encountered in draining it. Therefore, it is desirable to solve the defects of known room air conditioners by providing a simple and convenient means by which the stagnant water may be drained.

SUMMARY OF THE INVENTION

The present invention solves the defects of known air conditioners as described above, in that it provides a convenient handling lever which facilitates the draining of condensed water which has collected in the air conditioner. The present invention prevents corrosion caused by the stagnant retained water by employing one or more suitable drainage slots on a cylinder, with an accompanying piston which may be adjusted either to retain or drain the water through the slots.

The invention solves the defects of known room air conditioners through placement of a conveniently located manually operable lever which controls the placement of the piston in the cylinder. The cylinder is located on the bottom of a fluid drain pan inside the outdoor portion of the air conditioner. The cylinder contains slots which, when the lever has so positioned the piston, may alternatively be opened or closed. When the slots in the cylinder are open, the stagnant water may drain from the fluid drain pan.

BRIEF DESCRIPTION OF THE DRAWINGS

The invention is best understood by reading the following detailed description with reference to the following drawings, in which like reference numerals refer to like elements throughout, and in which.

DETAILED DESCRIPTION OF THE PREFERRED EMBODIMENTS

Briefly, the preferred embodiment of the present invention comprises: a cylinder with a cylinder holder having matched drainage slots, which holder and cylinder are disposed on the bottom surface of a fluid drain pan formed integrally on the base plate of the room air conditioner. A piston may be inserted into the cylinder so that the slots may be closed when the piston is pushed to a first position, and in which the slots are open when the piston is pulled to a second position. A lever with a conveniently located handle for manual manipulation causes the piston to be pushed into or pulled out of the cylinder to the first and second positions, respectively. A snap band spring is advantageously employed to hold the lever in the position in which the human user has placed it. Advantageously, the arrangement of the handle, lever, and piston may be implemented using a pivot arrangement.

Figure 1:
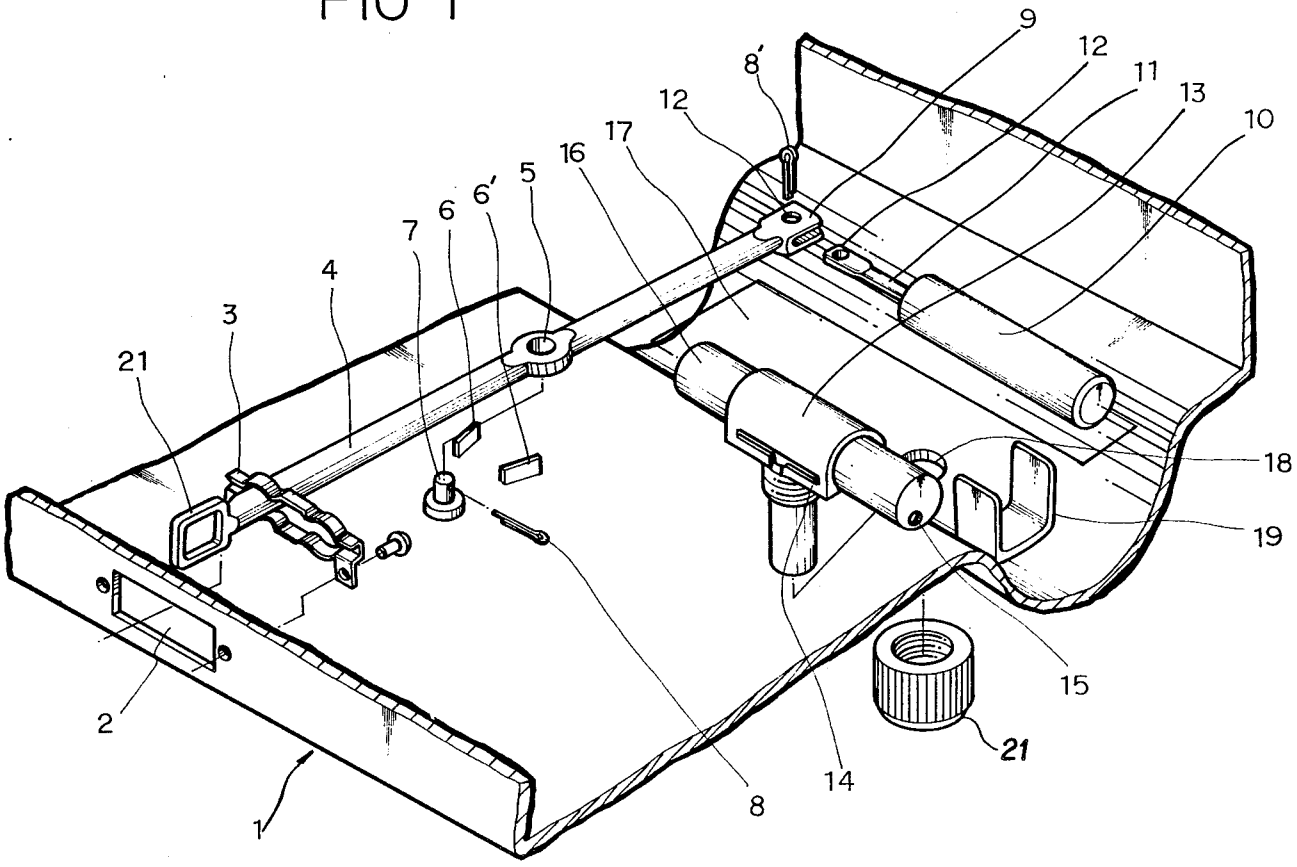
FIG. 1 is an exploded perspective view of the preferred embodiment of the room air conditioner fluid drainage device according to the present invention.
Figure 2:
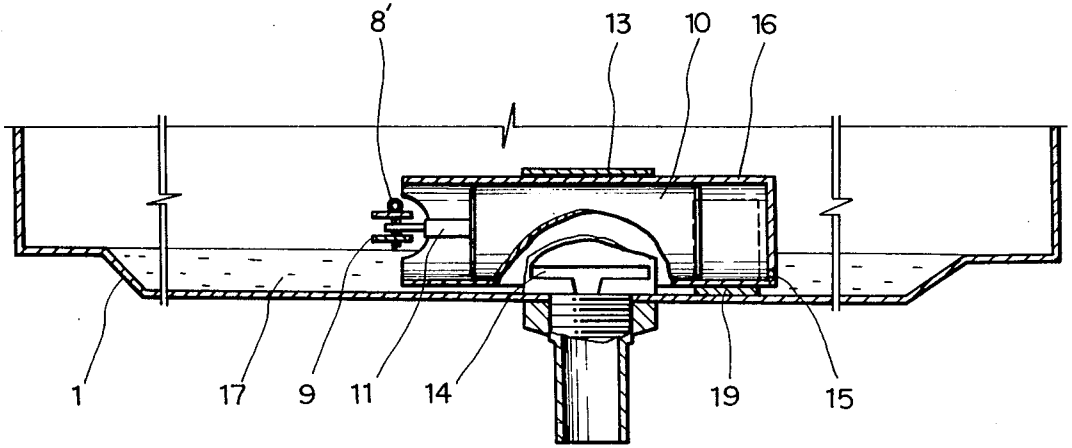
FIG. 2 is a cross-sectional view of the preferred embodiment of the present invention, in which the drainage lever is illustrated as set in a closed position.
Figure 3:
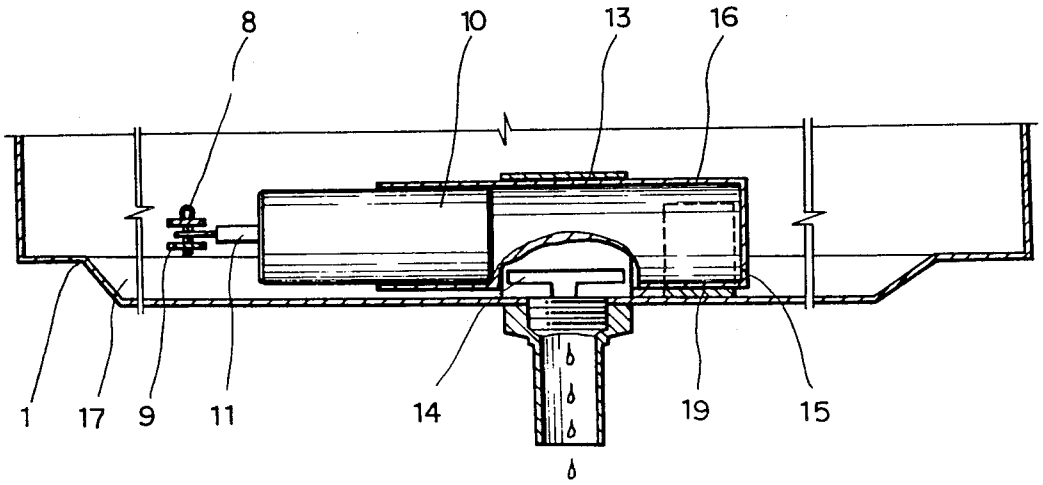
FIG. 3 is a cross-sectional view of the preferred embodiment of the present invention, in which the drainage lever is illustrated as set in an open position.

Referring to FIGS. 1, 2 and 3, a drainage lever 4 is inserted through a guide hole 2 which is located on the side of the base plate 1 of a room air conditioner. The drainage lever 4 is clamped between the upper and lower springs of a snap band spring 3. Snap band spring 3 is fixed at one end with a bolt to the base plate 1. Snap band spring 3 comprises at least two positions for releasably holding drainage lever 4 in respective extremem "open" and "closed" positions, to be described below. In the particular embodiment illustrated, snap band spring 3 has three positions, the middle position of which allows slower controlled drainage of fluid.

A fulcrum hole 5 is punched through roughly the middle portion of drainage lever 4 to facilitate the rotation of the drainage lever 4 about a pivot 7 which projects upwardly from base plate 1. The lever may be protected from upward removal from the pivot 7 by fixing a cotter pin 8 through the pivot. A pair of limiting structures 6, 6' are fixed to the base plate 1 so as to limit the horizontal rotation of drainage lever 4 about pivot 7.

A connecting rod 11 extends from a piston 10 to be inserted into a lever joint 9 which is formed at one end of drainage lever 4. Both of two joint holes 12, 12'0 are aligned so that a joint cotter pin 8' can be inserted therethrough.

One or more drainage slots 14 are advantageously located on either side of the bottom of a cylinder 16 as well as on a cylinder holder 13. The slots on cylinder 16 and cylinder holder 13 are aligned so as to be overlapped. Preferably, piston 10 fits snugly within the cylinder 16 so as to allow a fluid-tight closure of cylinder drainage slots 14 to be formed when the cylinder is inserted, so as to retain fluid in the fluid drain pan.

An air vent 15 is located on the head plate of cylinder 16. Holder 13, which may be formed integrally with cylinder 16, is fixed on the fluid drain pan 17 through an inserting hole 18, and is supported by a bracket 19. A drain pipe 21 may attach to cylinder holder 13 near inserting hole 18.

A handle 21, adapted for convenient use by any person, forms the other end of drainage lever 4. Advantageously, the handle 21 may be located on the indoor portion of the room air conditioner so as to facilitate the convenient operation of the invention.

Figure 4:
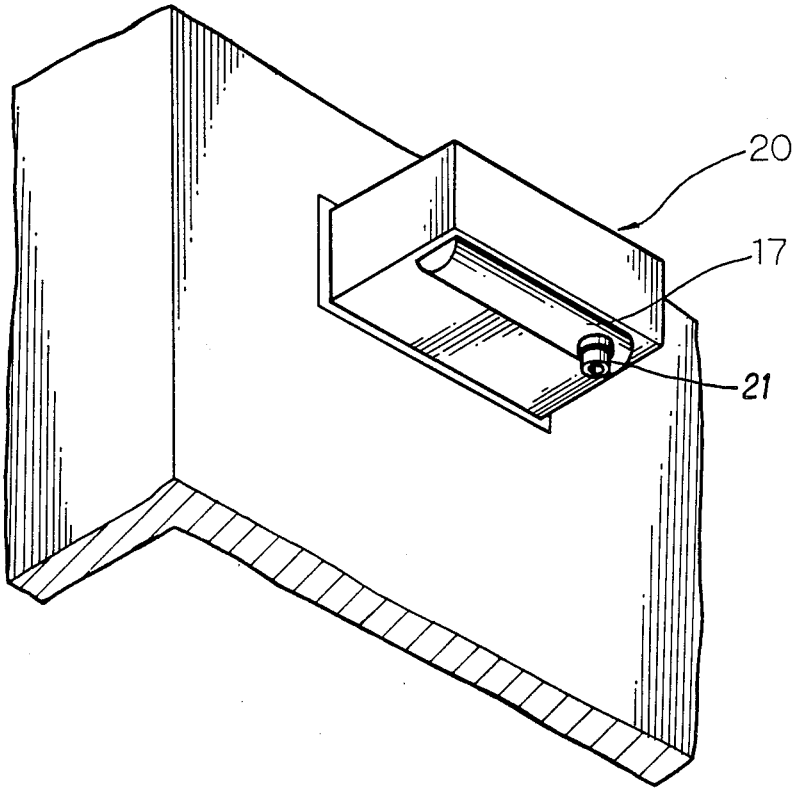
FIG. 4 is a perspective view showing the location of the drainpipe on the outside of a room air conditions, according to the preferred embodiment of the present invention.
Figure 5:
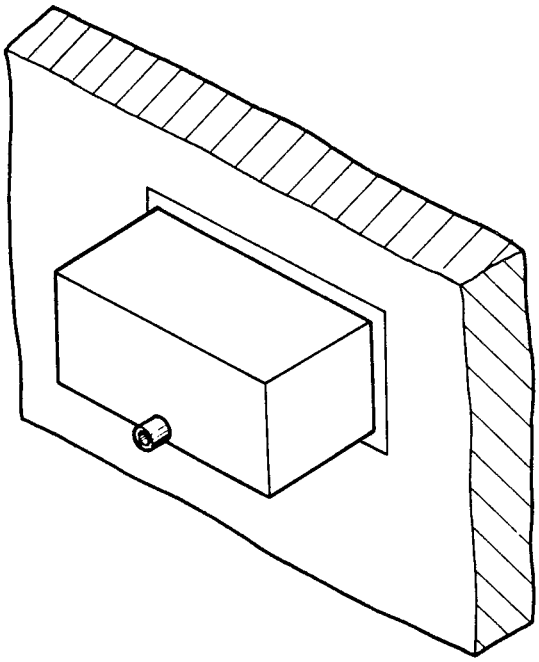
FIG. 5 is a perspective view illustrating the location of the drainpipe in conventional room air conditioners.

A room air conditioner is generally indicated as element 20 in FIG. 4. FIG. 4 shows how the stagnant water may be drained from fluid drain pan 17 through drain pipe 21 in a practical embodiment of the present invention. As FIG. 4 indicates, the fluid may be drained through the bottom of the fluid drain pan 17, rather than from the side, as is shown in the conventional air conditioner of FIG. 5.

In operation, where condensed water has stagnated in fluid drain pan 17 of the outdoor portion of a room air conditioner 20, drainage of the stagnant water may be accomplished when a handle 21 of drainage lever 4 is gripped and moved.

First, a description of the device's functioning to retain water will be presented, with reference to FIGS. 1 and 2. Drainage lever 4, which extends through guide hole 2, located at the side of base plate 1 of the air conditioner, is conveniently moved step by step from one position of snap band spring 3 to another, until a "closed" position is reached. As a result of this movement, drainage lever 4 rotates horizontally around pivot 7 to a degree controlled by the user, but the maximum amount of rotation is limited by limiting structures 6 and 6'. As the drainage lever rotates, lever joint 9 moves the connecting rod 11, which in turn causes piston 10 within cylinder 16 to close drainage slots 14. Stagnant water may thus be retained until a convenient time for disposal.

Drainage slots 14 may also be opened, allowing the stagnant water within the fluid drain pan 17 to flow rapidly into the cylinder 16 through the drainage slots 14. Complete drainage of the stagnant water may be accomplished when the device is adjusted as shown in FIG. 3. For drainage, drainage lever 4 may be put in an "open" position. Handle 21 is moved in the opposite direction as described above, and the movement of piston 10 will be the opposite to that described above. That is, as shown in FIG. 3, piston 10 may be pulled partially out of the cylinder 16 by acton of drainage lever 4, lever joint 9, and connecting rod 11, so that drainage slots 14 may be left open by the piston.

Advantageously, an air vent 15 is located on the head plate of cylinder 16, so that the movement of piston 10 may not be inhibited by compression or partial vacuum effects of the air in the cylinder 16 in response to changes in the position of handle 21.

In this manner, the present invention provides that the useful life of room air conditioners may be prolonged through a convenient mechanism for draining stagnant, condensed water from inside the air conditioner.

Whereas the invention has been described above in terms of a specific embodiment, it is to be understood that it has been presented by way of example, and not limitation. Thus, the breadth and scope of the present invention should be defined not by the above exemplary embodiment, but rather only in accordance with the following claims and their equivalents.

What is claimed is:

1. A drainage device for room air conditioners, comprising:

a base plate comprising a fluid drain pan with an inserting hole, and a side edge with a guide hole;

a drainage lever comprising a first end, a second end, and a fulcrum hole at or near its middle, said first end inserted through said guide hole;

a snap band spring means comprising three steps fixed to said base plate, for elastically clamping said drainage lever;

a pivot for insertion into said fulcrum hole for allowing said drainage lever to rotate;

a piston;

a connecting rod for connecting said piston to said second end of said drainage lever at a lever joint comprising joint holes;

a cylinder into which said piston is slidably inserted, comprising one or more cylinder drainage slots;

a cylinder holder, formed integrally with said cylinder and comprising one or more holder drainage slots matched to said cylinder drainage slots at lower portions of each, for affixing said cylinder to said fluid drain pan through said inserting hole; and a bracket for holding said cylinder.

2. The device according to claim 1, further comprising:

limiting structures for limiting the rotational motion of said drainage lever.

3. The drainage device according to claim 2, wherein:

said cylinder drainage slots and said holder drainage slots are characterized in that they are fully closed by said piston when said piston is pushed into a first position in said cylinder, so as to retain any stagnated condensed water; and said cylinder drainage slots and said holder drainage slots are fully open when said piston is pulled at least partially out of said cylinder, so as to drain any stagnated condensed water from the air conditioner.

* * * * *

UNITED STATES PATENT AND TRADEMARK OFFICE

CERTIFICATE OF CORRECTION

PATENT NO. :4,793,147
DATED :27 December 1988
INVENTOR(S) :Wooyeon CHO

It is certified that error appears in the above-indentified patent and that said Letters Patent is hereby corrected as shown below:

| | | |
|---|---|---|
| Column 1, | line 21, | before "stagnant", change "the" to --The--; |
| Column 2, | line 28, | after "respective", change "extremem" to --extreme--; |
| | line 43, | after "**12**, ", change "**12'0**" to --**12'**--: |

Signed and Sealed this

Twenty-seventh Day of August, 1996

*Attest:*

Bruce Lehman

BRUCE LEHMAN

*Attesting Officer*

*Commissioner of Patents and Trademarks*